US006549746B2

(12) United States Patent
Hauptmann

(10) Patent No.: US 6,549,746 B2
(45) Date of Patent: Apr. 15, 2003

(54) PROCESS AND DEVICE FOR PRINTING AND/OR COATING OF A SUBSTRATE

(75) Inventor: Gerald Erik Hauptmann, Bammental (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/023,124

(22) Filed: Dec. 17, 2001

(65) Prior Publication Data

US 2002/0102117 A1 Aug. 1, 2002

(30) Foreign Application Priority Data

Dec. 22, 2000 (DE) ..... 100 64 554

(51) Int. Cl.[7] ..... G03G 15/00
(52) U.S. Cl. ..... 399/341; 430/124
(58) Field of Search ..... 399/328, 329, 399/331, 339, 341; 219/216; 430/97, 124

(56) References Cited

U.S. PATENT DOCUMENTS 5,019,869 A * 5/1991 Patton ..... 219/216
5,249,949 A * 10/1993 Aslam et al. ..... 399/328
5,521,688 A 5/1996 Moser ..... 355/285
5,649,273 A * 7/1997 Shimizu et al. ..... 399/329
5,805,969 A 9/1998 Elsermans et al. ..... 399/341
5,970,301 A 10/1999 Decock ..... 399/341
6,101,345 A 8/2000 VanGoethem et al. ..... 399/69

FOREIGN PATENT DOCUMENTS

DE 42 16 366 C2 11/1995
DE 199 54 953 A1 5/2000

* cited by examiner

*Primary Examiner*—Joan Pendegrass
(74) *Attorney, Agent, or Firm*—Lawrence P. Kessler

(57) ABSTRACT

A process for printing and/or coating of a substrate, especially of paper or cardboard, is proposed. The process calls for at least one toner layer (1) to be transferred to the substrate and fixed on it, the surface (3) of a gloss variation device (5) acting at least in sections on at least one fixed toner layer (1), or one toner layer (1) in the course of being fixed, in order to influence the gloss of the fixed toner layer (1). In the process, depending on the gloss to be achieved, the force with which the surface (3) of the gloss variation device (5) acts on at least one toner layer (1) and/or at least one property of the surface (3) of the gloss variation device (5) is changed.

15 Claims, 3 Drawing Sheets

PROCESS AND DEVICE FOR PRINTING AND/OR COATING OF A SUBSTRATE

FIELD OF THE INVENTION

The invention relates to a process for printing and/or coating of a substrate, of paper or cardboard, a device for executing and a device for printing and/or coating a substrate, especially of paper or cardboard.

BACKGROUND OF THE INVENTION

In one known process of electrostatic printing, a latent electrostatic image is developed by charged toner particles. The latter are transferred to an image receiver substrate, which is hereinafter also called a substrate for short. Then the developed image which has been transferred to the substrate is fixed by the toner particles being warmed or heated and melted, and optionally the substrate being heated. To melt the toner particles, contact methods are often used, in which the toner particles are brought into contact with corresponding hot rollers or drums. To fix the toner which has been transferred for example to paper, there are furthermore heaters and processes which work without contact in which the toner particles are melted for example using heat/microwave radiation or hot air so that they stick to the paper.

In the printing or copying process in which the image applied to the substrate or the coating is developed by a toner, the gloss of the fixed toner does not follow the gloss of the paper, as is the case for example in offset printing. This applies both to contactless and also contact-making toner fixing processes. The reason for this is the greater layer thicknesses of the toners compared to the color layers produced in the offset printing process. The relatively thick toner layers fill the porosity of the paper, by which a smoothed surface structure and a certain gloss of the toner layer are formed.

In many cases it is desirable to adapt the gloss of the substrate surfaces covered with one or more fixed toner layers to the gloss of the uncovered surfaces of the substrate. For this purpose there have been gloss variation mechanisms, for example in the form of a calendar, which have a surface which acts with a predetermined force on at least one fixed toner layer or a toner layer in the course of being fixed, in order to vary the gloss of the fixed toner layer. One disadvantage of the known gloss variation mechanism is that the surface acting on the toner layer must be replaced by a surface with another structure when the aforementioned matching of the gloss of the fixed toner to the gloss of the uncovered surfaces of the substrate for different toner types and/or different substrates is to be done. The replacement of the corresponding surface of the gloss variation mechanism or the replacement of the entire gloss variation mechanism is however time-consuming and leads to the undesirable machine downtimes.

SUMMARY OF THE INVENTION

The object of the invention is to devise a process and a device with which the gloss of at least one toner layer fixed on the substrate can be varied without gloss variation mechanisms or parts thereof having to be replaced. Another object of the invention is to improve the printing or copying quality.

To achieve this object, a process is proposed which relates to printing and/or coating of a substrate, especially of paper or cardboard, at least one toner layer being transferred to the substrate and fixed on it. For example, in color printing the toner image can have four differently colored toner layers, conventionally one of the toner layers at a time being black, yellow, magenta and cyan. The liquid or dry toner has at least one polymer and color pigments and other constituents. When at least one toner layer is fixed, the polymer chains are crosslinked, by which a fixed toner layer is formed which is also called a polymer layer. The surface roughness and thus the gloss of this polymer layer depend largely on the density of the toner particles, their theological properties, and the melting process used. To match the gloss of the developed toner layer for example to the gloss of the uncovered surfaces of the substrate, there is a gloss variation device which has a surface which acts upon at least one fixed toner layer or one which is being fixed. To enable matching of the gloss, for example to various substrates, without replacing the gloss variation device or parts thereof, in the process it is provided that depending on the gloss to be achieved the force with which the surface of the gloss variation device acts on at least one toner layer and/or at least one property of the surface of the gloss variation device is changed. In this way, matching of the gloss in many cases can be done even during operation of the corresponding device, by which machine downtimes can be avoided and the throughput can be increased.

Changing at least one property of the surface of the gloss variation device can comprise changing the roughness of the surface of the gloss variation device. The roughness is determined especially by the distribution and the height of the elevations on the surface of the gloss variation device. In this connection it is possible to change the intervals of the elevations which determine the structure of the surface of the gloss variation device. Likewise, embodiments are conceivable in which the height of the elevations is changed, and changes the force with which the surface acts on at least one toner layer, preferably being chosen in this case such that the elevations for varying the gloss extend entirely into at least one toner layer.

One possibility for changing the structure of the surface of the gloss variation device is to elastically change the dimensions of the surface. In this connection rotation of the elastic material, which forms the surface of the gloss variation device leads to the distances between the individual elevations increasing, like the dimensions of the elevations themselves. When the forces which cause stretching of the elastic material which, forms the surface of the gloss variation device are reduced, the distances between the elevations and the dimensions of the elevations themselves decrease, again as a result of the elasticity of the material. The change in the dimensions of the surface of the gloss variation device can take place for example by changing the diameter of the drum, which forms the surface of the gloss variation device. Alternatively or additionally, it can be provided that the distance between and/or the length of at least the two drums around which an elastic belt is guided which forms the surface of the gloss variation device is changed.

In one embodiment of the process, it is provided that the gloss variation device is formed by a fixing device which is designed for fixing at least one toner layer. In this case the surface of the gloss variation device can be formed for example by the surface of a heated drum which is a component of the fixing device. The surface of the gloss variation device then acts on at least one toner layer in the course of fixing. This embodiment of the process is characterized by the space requirement being hardly increased at all relative to known devices without the gloss variation device.

In another embodiment of the process it is provided that there is a gloss variation device separate from the fixing device which is necessary for fixing at least one toner layer. In this case the gloss variation device can carry out final processing of the at least essentially already fixed toner layer. This can be advantageous for example in cases in which the gloss of at least one toner layer after fixing is acquired by measurement in order to match the final processing carried out by the glass variation device to the actual conditions.

In the process, it can furthermore be provided that via changing the force with which the surface of the gloss variation device acts on at least one toner layer, elevations of the surface of the gloss variation device which taper towards its free end can be pressed to different degrees into at least one toner layer. The elevations of the surface of the gloss variation device can have for example a pyramidal or conical shape. When a surface which is provided with these elevations acts with greater force on at least one toner layer, in this toner layer deeper notches are formed which lead to a reduction in the distances of the notch edges compared to the case in which this surface of the gloss variation device acts with a lower force on at least one toner layer.

In addition, in the process it can be provided that via changing the force with which the surface of the gloss variation device acts on at least one toner layer a different number of elevations of the surface of the gloss variation device is brought into contact with at least one toner layer. For this purpose, for example, it can be provided that the surface of the gloss variation device has elevations which have a different height. In this case, by the action of the surface with a greater force a larger number of elevations come into contact with at least one toner layer.

Changing at least one property of the surface of the gloss variation device can furthermore comprise application of particles to the surface of the gloss variation device and/or alignment of particles on the surface of the gloss variation device. The particles can be for example electrically charged particles, ferroelectric particles or magnetic particles. In this way it is for example possible to provide different printed surfaces of a picture with different gloss properties by digitally controlling the distribution of particles on the surface of the gloss variation device according to the gloss properties to be achieved.

In this connection, one embodiment of the process calls for the adhesion forces between the particles on the surface of the gloss variation device and the surface of the gloss variation device to be greater than the adhesion forces between the particles on the surface of the gloss variation device and at least one toner layer or the substrate. In this way it can be ensured that the particles, at least for the most part, are not transferred to the toner layer or to the substrate, but remain on the surface of the gloss variation device. In this case it is possible to re-align the particles accordingly.

Another embodiment of the process in this connection calls for the adhesion forces between the particles on the surface of the gloss variation device and the surface of the gloss variation device to be smaller than the adhesion forces between the particles on the surface of the gloss variation device and at least one toner layer or the substrate. In this way it is ensured in this embodiment that the particles, at least for the most part, are transferred to at least one toner layer or to the substrate. In this case, particles which extend over the surface of at least one toner layer form elevations, with a density which can be used to change the gloss within wide ranges.

The application of particles to the surface of the gloss variation device and/or the alignment of the particles on the surface of the gloss variation device can for example comprise one or more of the following process steps:

- powder coating processes,
- use of at least one beam of charged particles,
- producing and developing a latent electrostatic structure on the surface of the gloss variation device,
- producing and developing a latent magnetic structure on the surface of the gloss variation device,
- aligning electrically charged particles on the surface of the gloss variation device by controlled electrical fields,
- aligning ferroelectric particles on the surface of the gloss variation device by controlled electrical fields,
- aligning magnetic particles on the surface of the gloss variation device by controlled electrical fields, The invention relates furthermore to a device for printing and/or coating of a substrate, especially of paper or cardboard, with a fixing device for fixing of at least one toner layer on the substrate, and with a gloss variation device which acts on at least one fixed toner layer or one toner layer in the course of being fixed in order to influence the gloss of the fixed toner layer. In this printing device it is provided that the gloss variation device has a surface which acts with variable force on at least one toner layer and/or of which at least one property can be changed to influence the gloss of at least one fixed toner layer. One such printing device which is also suitable for executing the process is characterized in that the gloss of at least one toner layer can be adapted for example to the gloss of the substrate without the gloss variation device, or parts of it having to be replaced. The gloss can therefore be varied during operation of the printing device so that the printing device can prevent downtimes; this enables higher throughput. Furthermore, the printing device enables for example different surfaces of the same sheet to be provided with different gloss properties.

In the printing device it can be provided that the roughness of the surface of the gloss variation device can be changed. When the surface of the gloss variation device acts on at least one toner layer in the manner of an embossing process, thus via the roughness of the resulting toner layer its gloss can be influenced.

The roughness can for example be changed by the dimensions of the surface of the gloss variation device being elastically changed, as was explained in conjunction with the process.

Especially for this purpose, in the printing device it can be provided that the gloss variation device has at least one drum with a variable diameter and/or with a variable length. The drum surface then preferably forms at least in sections the surface of the gloss variation device which acts on at least one toner layer.

Alternatively, it can be provided that the gloss variation device has at least two drums with a variable distance and/or with a variable length. In this case an elastic belt is guided over at least two drums, the belt surface forming at least in sections the surface of the gloss variation device. The dimensions of the elastic belt and thus of the surface of the gloss variation device can thus be changed via changing the distance between the two drums and/or the length of the drums.

In the printing device it can either be provided that the fixing device forms the gloss variation device or that the gloss variation device is separate from the fixing device, reference being made to the corresponding disclosures in conjunction with the process.

The surface of the gloss variation device can have elevations with tapering free ends. If the surface of the gloss variation device acts on at least one toner layer in the manner of an embossing process, the embossed pattern which has been left on at least one toner layer and thus the gloss depend on the force with which at least one toner layer is acted upon.

In addition it can be provided in the printing device that the surface of the gloss variation device has elevations with different height. In this case the number of elevations coming into contact with at least one toner layer depends on the force with which at least one toner layer is acted upon. In this case it can also be provided that all or some of the elevations have tapering free ends.

Furthermore, it can be provided that the printing device has a mechanism for applying particles to the surface of the gloss variation device and/or for aligning particles on the surface of the gloss variation device, reference being made to the corresponding statements in conjunction with the process.

A mechanism for applying particles to the surface of the gloss variation device and/or for aligning particles on the surface of the gloss variation device can comprise for example one or more of the following:

- powder coating apparatus,
- particle beam generator to produce at least one beam of charged particles,
- mechanism for producing and developing a latent electrostatic structure on the surface of the gloss variation device,
- mechanism for producing and developing a latent magnetic structure on the surface of the gloss variation device,
- mechanism for alignment of electrically charged particles on the surface of the gloss variation device by controlled electrical fields,
- mechanism for alignment of ferroelectric particles on the surface of the gloss variation device by controlled electrical fields,
- mechanism for alignment of magnetic particles on the surface of the gloss variation device by controlled electrical fields.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENTS

Figure 1:
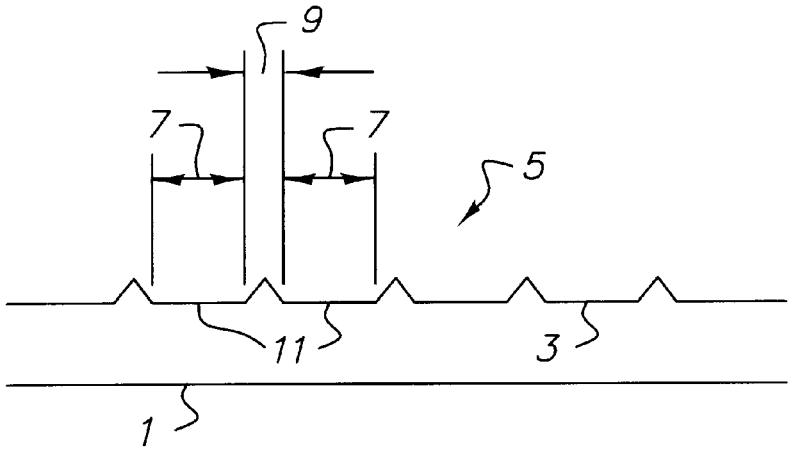
FIG. 1 shows one embodiment of the invention in which the dimensions of the surface of the gloss variation device can be elastically changed.
Figure 2:
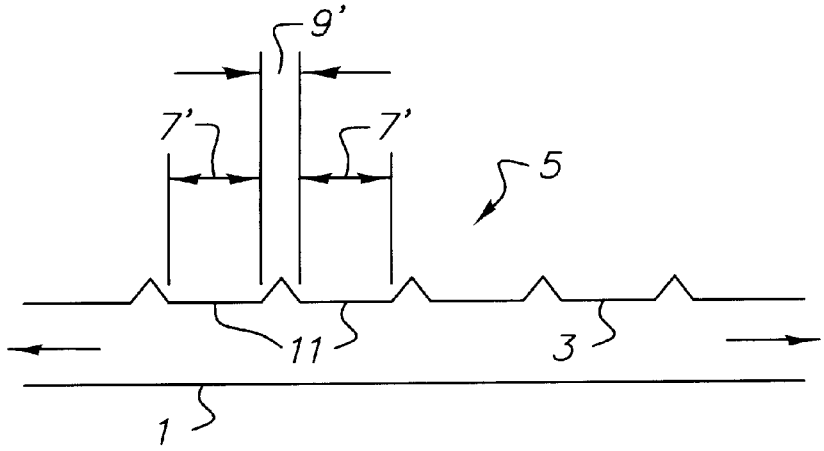
FIG. 2 shows the embodiment from FIG. 1 with extended dimensions of the surface of the gloss variation device.

In the embodiment from FIGS. 1 and 2 there is a gloss variation device 5 over a toner layer 1 which is fixed on a substrate which is not shown. The gloss variation device 5 has a surface 3 which is designed to act on a toner layer 1 in order to vary its gloss. The surface 3 is formed by a material which is elastic. As shown in FIG. 1, the material which forms the surface 3 is in the relieved state, i.e., in the rest position. The surface 3 has elevations 11 which in the relieved state of the material have a length 7 and are arranged with a distance 9 to one another.

In FIG. 2 the dimensions of the surface 3 compared to the representation in FIG. 1 are increased by stretching the material which forms the surface 3 in the direction of the arrows shown in FIG. 2. Stretching the material which forms the surface 3 yields elevations 11 with a greater length 7'. Furthermore, the distance 9' between the individual elevations 11 is increased. The density of the embossed pattern which has been left by the surface 3 on the toner layer 1 and thus the gloss of the fixed toner layer 1 can be varied in this embodiment by a corresponding change in the dimensions of the surface 3.

Figure 3:
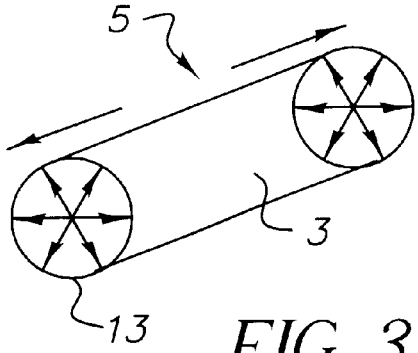
FIG. 3 shows a schematic of one embodiment of the invention, in which a drum with a variable diameter and variable length forms the surface of the gloss variation device.

FIG. 3 shows a first drum 13 which in the embodiment of the invention is a component of the gloss variation device. The drum 13 has a variable diameter and a variable length, as is indicated by the arrow in FIG. 3. At least the outside periphery of the drum 13 consists of an elastic material which forms the surface 3 of the gloss variation device 5. The surface 3 can be structured for example according to FIGS. 1 and 2, the increase in the diameter of the drum 13 then increasing the dimensions of the surface 3, while a reduction in the diameter accordingly leads to a reduction in the dimensions of the surface 3.

Figure 4:
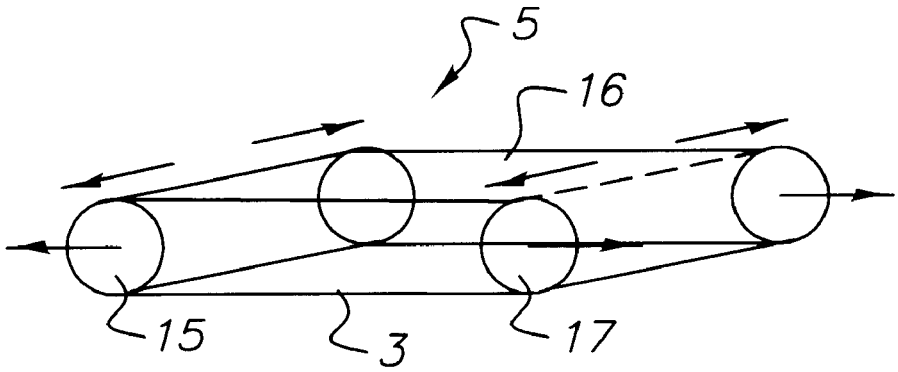
FIG. 4 shows a schematic of one embodiment of the invention in which two drums with a variable interval and variable length guide an elastic belt which forms the surface of the gloss variation device.

FIG. 4 shows a schematic of one embodiment of the invention in which two drums with a variable interval and variable length guide an elastic belt which forms the surface of the gloss variation device. As shown in FIG. 4, there are a second drum 15 and a third drum 17 with a variable distance. In addition to the distance between the drums, the length of the second drum 15 and the third drum 17 can be changed, as is indicated by the arrows in FIG. 4. A belt 16 of elastic material is guided around the second drum 15 and the third drum 17 and forms the surface 3 of the gloss variation device 5. This surface 3 can be structured for example according to FIGS. 1 and 2. The structure or the roughness of the surface is changed in the embodiment from FIG. 4 by changing the dimensions of the surface 3 via increasing or decreasing the distance between the first drum 15 and the second drum 17 and/or by changing the length of these drums.

Figure 5:
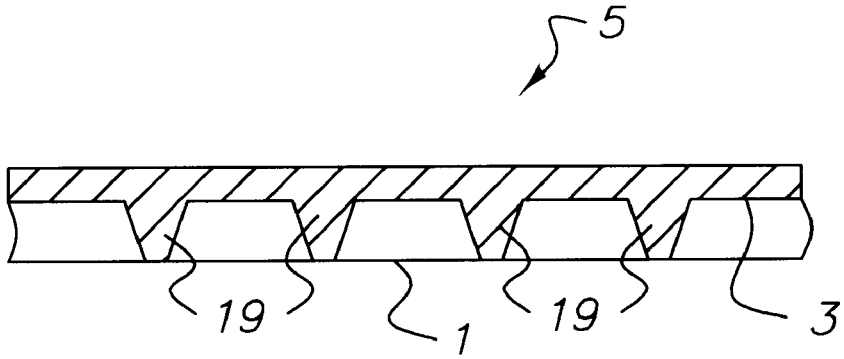
FIG. 5 shows a schematic of one embodiment of the invention in which the surface of the gloss variation device has elevations which taper towards the free ends.

FIG. 5 shows a schematic of one embodiment of the invention in which the surface 3 of the gloss variation device 5 has tapering elevations 19. In this embodiment the elevations 19 taper conically. In this embodiment the tapering elevations 19, depending on the force with which the surface 3 acts on the toner layer 1, penetrate to varying degrees into the toner layer 1. The farther the tapering elevations 19 penetrate into the toner layer 1, the deeper and larger become the notches or depressions which have been produced in the toner layer 1, by which the gloss of the toner layer 1 processed in this way can be varied.

Figure 6:
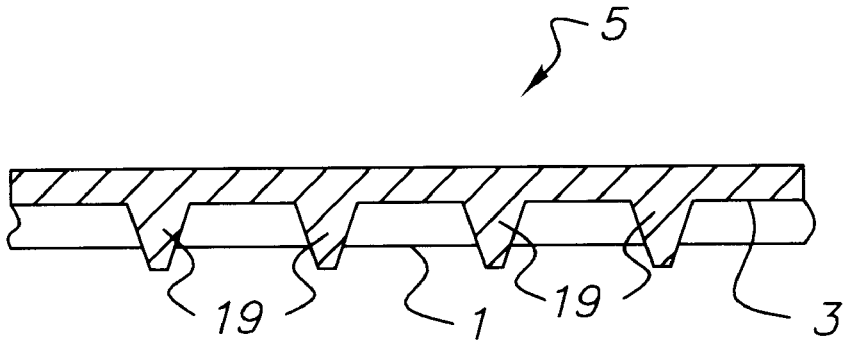
FIG. 6 shows the embodiment of the invention as shown in FIG. 5 in one working position.

FIG. 6 shows the embodiment from FIG. 5 in one working position, in which the elevations 19 of the surface 3 have penetrated roughly one half into the toner layer 1.

Figure 7:
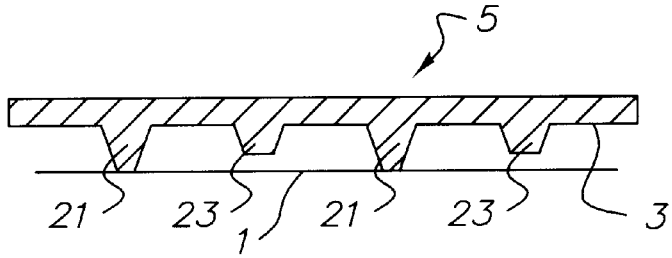
FIG. 7 shows the embodiment of the invention in which the surface of the gloss variation device has elevations with different height.

FIG. 7 shows one embodiment of the invention in which the surface 3 of the gloss variation device 5 has elevations 21, 23 with different height. In this case there are elevations 21, 23 with two different heights, the elevations 21 having a greater height than the elevations 23. Of course, embodiments are also possible in which there are elevations with more than two different heights. In this case the elevations 21, 23 and the elevations 19 in FIGS. 5 and 6 have a shape which tapers toward the free end of the elevations 21, 23. In this embodiment, not only the size and depth of the notches or recesses produced in the toner layer 1 can be influenced via the force with which the surface 3 acts on the toner layer 1, but also their number per unit of area. This is due to the fact that the elevations 23 which have a lower height only come into contact with the toner layer 1 when the force with which the surface 3 acts on the toner layer 1 exceeds a certain boundary value.

Figure 8:
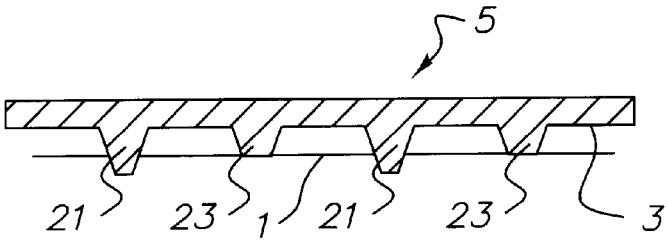
FIG. 8 shows the embodiment of the invention from FIG. 7 in the working position.

FIG. 8 shows the embodiment from FIG. 7 in the working position, in which the higher elevations 21 have already penetrated relatively far into the toner layer 1, while the lower elevations 23 have only just come into contact with the toner layer 1. Although not absolutely essential, the embodiment from FIGS. 7 and 8 combines the advantages of the elevations 19 tapering toward their free ends as shown in FIGS. 5 and 6 with the advantages of a surface 3 which has elevations 21, 23 with different height.

Figure 9:
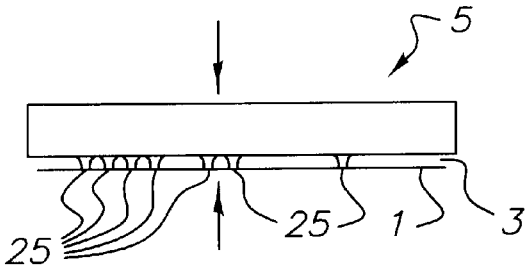
FIG. 9 shows the embodiment of the invention in which there are particles on the surface of the gloss variation device, the particles during and after action on at least one toner layer remaining on the surface of the gloss variation device.

FIG. 9 shows an embodiment of the invention in which there are particles 25 on the surface 3 of the gloss variation device 5. In this embodiment the adhesion forces between the particles 25 on the surface 3 and the surface 3 are greater than the adhesion forces between the particles 25 on the surface 3 and the toner layer 1, or, if there are particles 25 there at all, the surfaces of the substrate which are not covered with a toner layer 1. In this way it is ensured that the particles 25 at least for the most part are not transferred to the toner layer or to the substrate. The adhesion forces can be suitably adjusted via van der Waals forces and optionally by electrostatic forces.

Figure 10:
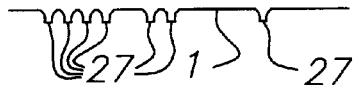
FIG. 10 shows a toner layer which was processed with the device from FIG. 9.

FIG. 10 shows a toner layer 1 which was processed with the device from FIG. 5. As can be seen in FIG. 10, the particles 25 have left a pattern of notches on the toner layer 1 which corresponds to the arrangement of particles 25 on the surface 3. In this embodiment, by the arrangement or alignment and size of the particles 24 and via the force with which the surface 3 acts on the toner layer, an embossed pattern which is specially matched to the respective requirements can be produced on or in the toner layer 1, so that the gloss can be varied within wide limits.

Figure 11:
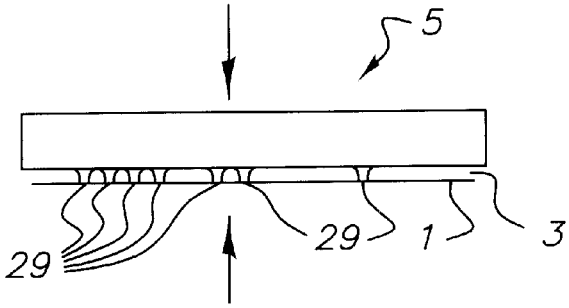
FIG. 11 shows the embodiment of the invention in which there are particles on the surface of the gloss variation device, the particles during action on at least one toner layer being transferred to the latter.

FIG. 11 shows the embodiment of the invention in which there are particles 29 on the surface 3 of the gloss variation device 5. In this embodiment the adhesion forces between the particles 29 on the surface 3 and the surface 3 are smaller than the adhesion forces between the particles 29 on the surface 3 and at least one toner layer 1 or the substrate. This results in that the particles 29 at least for the most part are transferred to the toner layer 1. If there are particles 29 at all in the surfaces of the substrate which are not covered with the toner layer 1, they can optionally also influence the surface properties of the surfaces of the substrate 1 not covered with a toner layer. In this case as well, the adhesion forces can be suitably adjusted via van der Waals forces and optionally by electrostatic forces.

Figure 12:
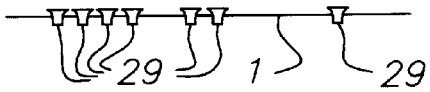
FIG. 12 shows a toner layer which was processed with the device from FIG. 11.

FIG. 12 shows a toner layer 1 which was processed with the device from FIG. 11. As can be seen in FIG. 12, the particles 29 were transferred according to their original arrangement on the surface 2 onto the toner layer 1, where they form the corresponding elevations which influence the gloss of the toner layer 1.

The embodiments should not be understood as a limitation of the invention. Rather, within the framework of this disclosure numerous modifications and changes are possible, especially those versions, elements and combinations and/or materials which for example by combination or modification can be taken from individual features or elements for process steps which are contained in the drawings and which are described in the general specification and embodiments and the claims, for one skilled in the art with respect to achieving the object, and lead to a new subject matter or new process steps or sequences of process steps by combinable features.

Parts List

1 toner layer
3 surface
5 gloss variation device
7 width of elevations
9 interval of elevations
11 elevations
13 first drum
15 second drum
16 elastic belt
17 third drum
19 conical elevations
21 high elevations
23 low elevations
25 first particle
27 notches
29 second particle

What is claimed is:

1. Process for printing and/or coating of a substrate, especially of paper or cardboard, in which at least one toner layer (1) is transferred to the substrate and fixed on it, the surface (3) of a gloss variation device (5) acting at least in sections on at least one fixed toner layer (1), or one toner layer (1) in the course of being fixed, in order to influence the gloss of the fixed toner layer (1), characterized in that depending on the gloss to be achieved, the force with which the surface (3) of the gloss variation device (5) acts on at least one toner layer (1) and/or at least one property of the surface (3) of the gloss variation device (5) is changed wherein changing at least one property of the surface (3) of the gloss variation device (5) comprises the elastic change of the dimensions of the surface (3) of the gloss variation device (5).

2. Process as claimed in claim 1, wherein via changing the force with which the surface (3) of the gloss variation device (5) acts on at least one toner layer (1), elevations (19, 21, 23) of the surface (3) of the gloss variation device (5) which taper towards its free end are pressed to different degrees into at least one toner layer (1).

3. Process as claimed in claim 1, wherein via changing the force with which the surface (3) of the gloss variation device (5) acts on at least one toner layer (1), a different number of elevations (21, 23) of the surface (3) of the gloss variation device (5) are brought into contact with at least one toner layer (1).

4. Process as claimed in claim 1, wherein changing at least one property of the surface (3) of the gloss variation device (5) comprises the application of particles (25, 29) to the surface (3) of the gloss variation device (5) and/or alignment of particles (25, 29) on the surface (3) of the gloss variation device (5).

5. Process as claimed in claim 4, wherein the adhesion forces between the particles (25) on the surface (3) of the gloss variation device (5) and the surface (3) of the gloss variation device (5) are greater than the adhesion forces between the particles (25) on the surface (3) of the gloss variation device (5) and at least one toner layer (1) or the substrate in order to ensure that the particles (25) at least for the most part are not transferred to at least one toner layer (1) or to the substrate.

6. Process as claimed in claim 4, wherein the adhesion forces between the particles (29) on the surface (3) of the gloss variation device (5) and the surface (3) of the gloss variation device (5) are smaller than the adhesion forces between the particles (29) on the surface (3) of the gloss variation device (5) and at least one toner layer (1) or the substrate in order to ensure that the particles (29) at least for the most part are transferred to at least one toner layer (1) or to the substrate.

7. Process as claimed in claim 4, wherein the application of particles (25, 29) to the surface (3) of the gloss variation device (5) and/or the alignment of the particles (25, 29) on the surface (3) of the gloss variation device (5) comprises one or more process steps selected from the group of process steps including:

powder coating processes;

use of at least one beam of charged particles;

producing and developing a latent electrostatic structure on the surface of the gloss variation device;

producing and developing a latent magnetic structure on the surface of the gloss variation device;

aligning electrically charged particles on the surface of the gloss variation device by controlled electrical fields;

aligning ferroelectric particles on the surface of the gloss variation device by controlled electrical fields;

aligning magnetic particles on the surface of the gloss variation device by controlled electrical fields.

8. Device for printing and/or coating of a substrate, especially of paper or cardboard, with a fixing device for fixing of at least one toner layer (1) on the substrate, and with a gloss variation device (5) which acts on at least one fixed toner layer (1), or one toner layer (1) in the course of being fixed, in order to influence the gloss of the fixed toner layer (1), wherein the gloss variation device (5) has a surface (3) with elevations (11) which surface acts with variable force on at least one toner layer (1) and/or of which at least one property can be changed to influence the gloss of at least one fixed toner layer (1); wherein the distances (9,9') of the elevations (11) of the surface (3) of the gloss variation device (5) can be changed.

9. Device as claimed in claim 8, wherein the dimensions of the surface (3) of the gloss variation device (5) can be elastically changed.

10. Device as claimed in claim 8, wherein the gloss variation device (5) has at least one drum (13) with a variable diameter and/or with a variable length and wherein the drum surface forms at least in sections the surface (3) of the gloss variation device (5).

11. Device as claimed in claim 8, wherein the gloss variation device (5) has at least two drums (15, 17) with a variable distance and/or with a variable length and wherein an elastic belt (16) is guided over at least two drums (15, 17), and wherein the belt surface at least in sections forms the surface (3) of the gloss variation device (5).

12. Device as claimed in claim 8, wherein the surface (3) of the gloss variation device (5) has elevations (19, 21, 23) with tapering free ends.

13. Device as claimed in claim 8, wherein the surface (3) of the gloss variation device (5) has elevations (21, 23) with different height.

14. Device as claimed in claim 8, wherein it has a mechanism for application of particles (25, 29) to the surface (3) of the gloss variation device (5) and/or for the alignment of particles (25, 29) on the surface (3) of the gloss variation device (5).

15. Device as claimed in claim 8, wherein the mechanism for the application of particles (25, 29) to the surface (3) of the gloss variation device (5) anchor for the alignment of the particles (25, 29) on the surface (3) of the gloss variation device (5) comprises one or more process apparatus selected from the group of process apparatus including:

powder coating apparatus;

particle beam generator to produce at least one beam of charged particles;

mechanism for producing and developing a latent electrostatic structure on the surface of the gloss variation device;

mechanism for producing and developing a latent magnetic structure on the surface of the gloss variation device;

mechanism for alignment of electrically charged particles on the surface of the gloss variation device by controlled electrical fields;

mechanism for alignment of ferroelectric particles on the surface of the gloss variation device by controlled electrical fields;

mechanism for alignment of magnetic particles on the surface of the gloss variation device by controlled electrical fields.

* * * * *